US006823613B2

(12) United States Patent
Kelly et al.

(10) Patent No.: US 6,823,613 B2
(45) Date of Patent: Nov. 30, 2004

(54) STUDDED FOOTWEAR

(75) Inventors: Paul Andrew Kelly, Atherstone (GB); Lee Paul Shuttleworth, Hall Green (GB)

(73) Assignee: Trisport Limited (GB)

( * ) Notice: Subject to any disclaimer, the term of this patent is extended or adjusted under 35 U.S.C. 154(b) by 8 days.

(21) Appl. No.: 09/987,238

(22) Filed: Nov. 14, 2001

(65) Prior Publication Data

US 2002/0056210 A1 May 16, 2002

Related U.S. Application Data

(60) Provisional application No. 60/249,461, filed on Nov. 20, 2000.

(30) Foreign Application Priority Data

Nov. 14, 2000 (GB) ..... 0027750

(51) Int. Cl.[7] ..... A43B 5/02; A43C 15/16

(52) U.S. Cl. ..... 36/134; 36/127; 36/128; 36/67 D

(58) Field of Search ..... 36/127, 128, 134, 36/67 D

(56) References Cited

U.S. PATENT DOCUMENTS 3,911,600 A * 10/1975 Dassler ..... 36/67 D
4,445,288 A * 5/1984 Fror ..... 36/134
4,587,748 A * 5/1986 Collins ..... 36/127
4,698,923 A * 10/1987 Arff ..... 36/128
5,321,901 A 6/1994 Kelly
5,848,482 A 12/1998 Bathum
5,974,700 A 11/1999 Kelly
6,332,281 B1 * 12/2001 Savoie ..... 36/134
6,463,682 B1 * 10/2002 Carroll, Jr. ..... 36/134

FOREIGN PATENT DOCUMENTS

| | | |
|---|---|---|
| GB | 335594 | 9/1930 |
| GB | 2202916 | 10/1988 |
| GB | 002777609 | 11/2000 |
| WO | WO 89/04616 | 6/1989 |

* cited by examiner

*Primary Examiner*—Ted Kavanaugh
(74) *Attorney, Agent, or Firm*—Edell, Shapiro & Finnan, LLC

(57) ABSTRACT

A shoe stud for a sports shoe has a ground-engaging part and a multi-start threaded spigot for engagement in a complementary socket on a receptacle secured in the shoe sole or heel. The stud and receptacle also have a locking device which inter-engages when the spigot is fully inserted into the socket, to resist unscrewing. In order to ensure that the stud takes up a precise position relative to the receptacle, which may be needed if the stud is not rotationally symmetrical, the stud and receptacle have means to determine the initial position of the stud relative to the receptacle, and means to determine the final position of the stud relative to the receptacle. Determination of the initial position may be provided by a thread and complementary groove of the screw-thread connection which are of different dimensions from the others.

18 Claims, 4 Drawing Sheets

STUDDED FOOTWEAR

CROSS-REFERENCE TO RELATED APPLICATION

This application is a continuation of and relies for priority on prior U.S. Provisional Patent application Ser. No. 60/249,461, filed Nov. 20, 2000, the entire disclosure of which is incorporated herein by reference.

BACKGROUND OF THE INVENTION

1. Technical Field

This invention relates to studded footwear such as sports shoes, for example football boots track and field shoes, golf shoes, and footwear for other sports. The term "football" is intended to encompass all sports known as football, such as soccer, rugby and American and Australian football.

2. Discussion of Known Art

The studs of the present invention are intended to provide traction, having a ground-engaging part of a type suited to the sport involved. Thus, studs for football tend to have relatively sharp ground-piercing spikes, while those for golf shoes currently have several relatively soft and blunt ground-gripping or turf-engaging cleats. The studs are detachably fastened to the sole of the article of footwear, by a screw-threaded spigot on the stud engaging in a correspondingly threaded socket in a receptacle melded in, or otherwise secured to, the shoe sole.

The screw-threaded connection must be designed to ensure that the stud remains in place, even when high torque or traction forces are applied, and in particular that the stud does not unscrew accidentally. Known studs have either a single start thread or a multi-start thread. A single start thread is the simplest thread form and provides a greater resistance to unscrewing than a multi-start thread. It also provides a strong connection over the several turns of the thread on the spigot and socket. However, because of the number of turns needed to attach and detach the stud, removal and replacement with a single start thread becomes a time-consuming operation. A multi-start thread has a steeper helix angle, which enables a spigot of any given length to be inserted into the socket with less rotation. Also, because a multi-start thread is deeper cut than a single start thread, the shear strength of the thread is greater, so that a shorter spigot can be used.

Whether a single start or multi-start thread is used, the studs and sockets also typically incorporate a locking ratchet to prevent accidental unscrewing of the studs. Typically, the stud and socket each have a set of teeth which inter-engage as the stud is inserted into the socket. The arrangement of the teeth allows the stud to be in any one of a number of positions relative to the socket when it is fully inserted.

The screw threads and locking ratchets described are quite adequate where the final rotational orientation of the stud relative to the sole is not significant. In fact, currently most studs are circular or otherwise rotationally symmetrical, and their final rotational or angular orientation relative to the shoe sole is not relevant.

However, in some sports where the forces on the studs are relatively high and of a particular type, such as lateral forces or forces due to rapid forward acceleration of the wearer of the shoe, studs which are specifically oriented can be more effective. (The term "specifically-oriented stud" will be used herein to include studs which are non-rotationally symmetrical, or studs which are rotationally symmetrical but whose final orientation relative to the shoe sole is significant.) A specifically-oriented stud must be oriented very precisely relative to the shoe sole to ensure that it functions in the desired manner. The known screw-threads and locking ratchets are unable to provide this precise orientation. For example, although a single start thread orients the stud at the start of its insertion, the multiple turns and the locking ratchet mean that its final position cannot be predicted. A multi-start thread of course provides a plurality of starting positions, and the locking ratchet a plurality of end positions.

OBJECTS AND SUMMARY OF THE INVENTION

The present invention aims to ensure that a stud can be precisely oriented relative to its socket and receptacle; orientation of the receptacle relative to the shoe sole is of course necessary, but does not form part of this invention.

According to a first aspect of the present invention, in a combination of a shoe stud and receptacle, the shoe stud includes a ground-engaging part; the two components are adapted to be secured together by a multi-start threaded connection comprising a screw-threaded spigot on one of the two components adapted to be inserted with rotation into a screw-threaded socket on the other component. A locking means for the components is arranged to become inter-engaged at least when the spigot is fully inserted into the socket to resist unscrewing of the assembly. The stud and receptacle have means to determine the initial position of the stud relative to the receptacle, and means to determine the final position of the stud relative to the receptacle.

Thus, the initial angular orientation and the final orientation of the stud relative to the receptacle are both determined. A stud can therefore be specifically oriented relative to the receptacle, and hence to the shoe sole.

The multi-start thread may have two, three or more starts, to reduce the number of turns required to attach and detach the stud. In one embodiment the thread is a three-start thread, and in another embodiment it is a six-start thread. This enables the stud to be attached in half a turn, which makes removal and attachment easy.

The means to determine the initial position of the stud relative to the receptacle may be provided by the threaded connection, with one of the threads and grooves being different from the other or others to provide a key and complementary keyway.

The key may comprise an enlarged thread on one of the components and a correspondingly enlarged groove on the other component. The thread and groove are preferably enlarged radially. The enlarged thread will only fit in the enlarged groove, thus determining the initial position. The strength of the threaded connection is not affected significantly by this.

Alternatively, the key comprises a bridged thread on one of the components, and a removed thread on the other component. Thus, on the one component the space between the crests of two adjacent threads is filled in, and on the other component the thread between two adjacent roots is removed. This provides the necessary initial orientation of the stud relative to the socket, while not affecting the strength of the threaded connection significantly.

Conveniently the key is provided on the receptacle and the keyway on the stud. Alternatively the key could be on the stud and the keyway on the receptacle.

The locking means preferably comprises radially facing locking formations on the stud and receptacle operative to come into mutual engagement when the spigot has been screwed into the socket to a predetermined axial position. One of the locking formations comprises at least one radial projection, while the other comprises at least a radially-facing lead-in ramp, recess and stop means. The projection rides over a lead-in ramp before snapping into a recess, and then engages the stop means to prevent the stud from being screwed any further into the socket. The locking means allows the stud to be unscrewed in response to application of a predetermined torque by resilient yielding of the locking formations. This locking means has the advantage of providing a tactile and audible indication of locking, as the projection makes a click which may be felt and/or heard as it snaps into the recess. This locking means also adds to the strength of the connection between the stud and the receptacle. Preferably two locking formations are provided, but it would be possible to provide four or more.

Where the stud is attached in half a turn and two locking formations are provided, the locking formations may be on different diameters. This helps to provide a positive initial orientation of the stud and ensures that no cross-threading can occur.

The projections are on different diameters, while the ramps, recesses and stop means are formed on the walls of annular channels of corresponding diameters.

Alternatively, the locking means may comprise locking formations as a ring of posts extending axially from one of the components and a ring of radially projecting teeth on the other component, arranged such that when the spigot has been screwed into the socket to a predetermined axial position, engagement of the teeth with the posts causes resilient deflection of the posts, and engagement of the teeth between the posts causes inter-engagement of the locking means.

With either type of locking means it is easy to arrange the locking formations circumferentially relative to the key and keyway to ensure the precise final orientation of the stud relative to the receptacle. The stud may therefore be a specifically-oriented stud, and in particular a non-rotationally symmetrical stud.

The method of orienting the stud relative to the receptacle may also form part of the invention. A second aspect of the invention relates specifically to a shoe stud.

According to a second aspect of the invention, a stud, for use with an article of studded footwear having a receptacle with a multi-start screw-threaded socket, has a spigot with a multi-start screw thread complementary to the screw thread of the socket, such that rotary insertion of the spigot into the socket secures the stud in the socket. The spigot includes one component of a helical key and complementary keyway, of which the other component is provided on the receptacle, the helical key and keyway defining the position of the spigot relative to the receptacle at the start of the insertion of the spigot into the socket.

Preferably the keyway is provided on the spigot, but it may instead be provided on the receptacle.

The keyway preferably comprises a groove of the screw-thread on the spigot which is of different dimensions from the other or others. For example, the groove may comprise an enlarged groove; that is, the groove may be enlarged radially or by the removal of a thread.

The stud may also include one component of a locking means, of which a complementary component is provided on the receptacle to receive the stud in the socket. The stud may be a specifically-oriented stud, and in particular a non-rotationally symmetrical stud.

A third aspect of the invention relates to a receptacle for incorporation in an article of studded footwear, the receptacle being adapted to receive a stud.

According to a third aspect of the invention, a receptacle for incorporation in an article of studded footwear has a multi-start screw-threaded socket adapted to receive a spigot of a shoe stud. The spigot has a multi-start screw thread complementary to the screw thread of the socket, such that rotary insertion of the spigot into the socket secures the stud in the receptacle. The receptacle has one component of a helical key and complementary keyway of which the other component is provided on the spigot, the helical key and keyway defining the position of the spigot relative to the receptacle at the start of the insertion of the spigot into the socket.

Preferably the key is provided on the receptacle, but it may instead be provided on the spigot.

The keyway preferably comprises a thread of the screw-thread on the socket which is of different dimensions from the other or others. The thread may comprise an enlarged thread which may be enlarged radially or formed by a bridged thread.

The receptacle may also have one component of a locking means, of which a complementary component is provided on the stud.

The aforesaid objects are achieved individually and in combination, and it is not intended that the present invention be construed as requiring two or more of the objects to be combined unless expressly required by the claims attached hereto.

The above and still further objects, features and advantages of the present invention will become apparent upon consideration of the following definitions, descriptions and descriptive figures of specific embodiments thereof wherein like reference numerals in the various figures are utilized to designate like components. While these descriptions go into specific details of the invention, it should be understood that variations may and do exist and would be apparent to those skilled in the art based on the descriptions herein.

DESCRIPTION OF THE PREFERRED EMBODIMENTS

Figure 5:
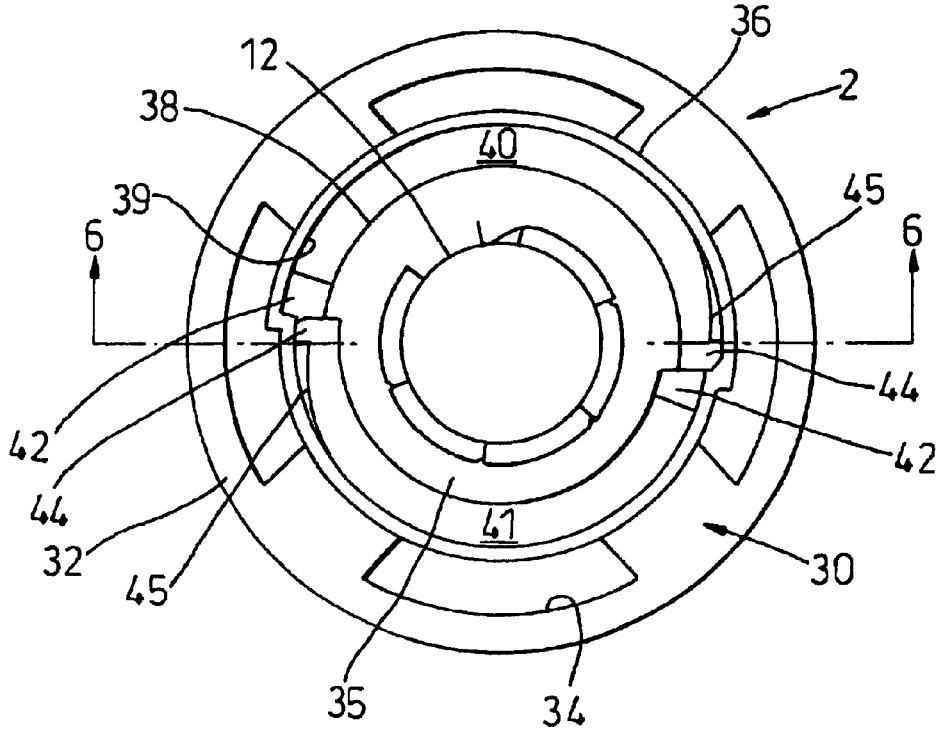
FIG. 5 is an bottom plan view of a receptacle for the stud of FIGS. 1 to 4.
Figure 6:
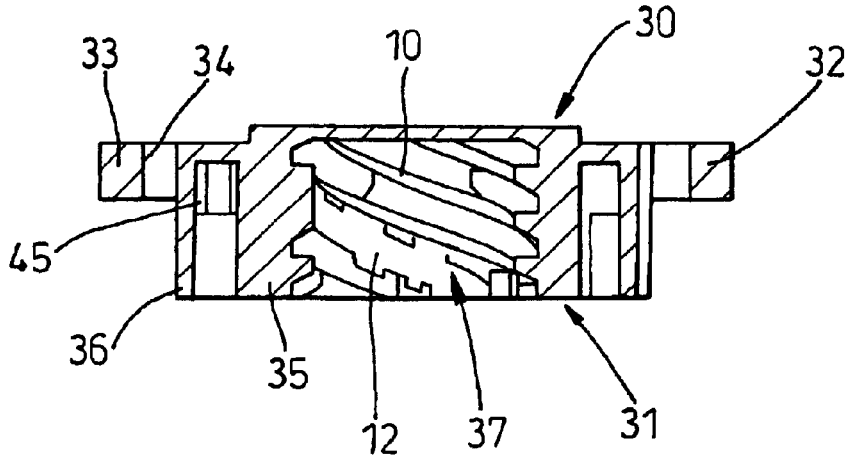
FIG. 6 is a section along the line 6—6 of FIG. 5.
Figure 9:
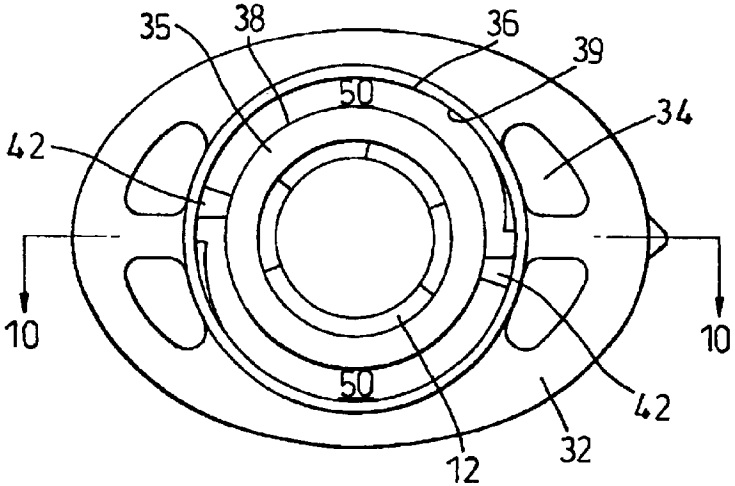
FIGS. 9 and 10 are similar to FIGS. 5 and 6, but show a modified receptacle for the stud of FIGS. 7 and 8.
Figure 10:
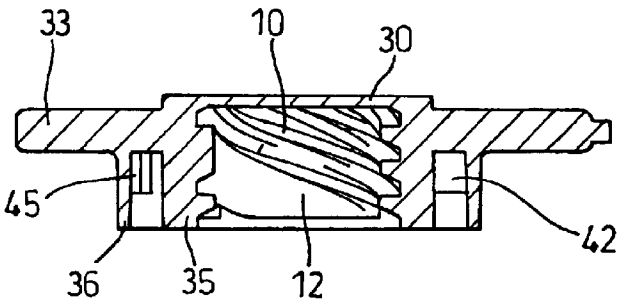
Figure 7:
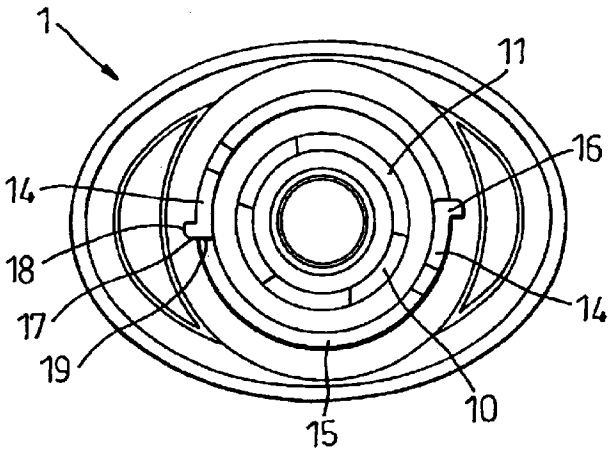
FIGS. 7 and 8 are similar to FIGS. 2 and 3, but show a modification.
Figure 8:
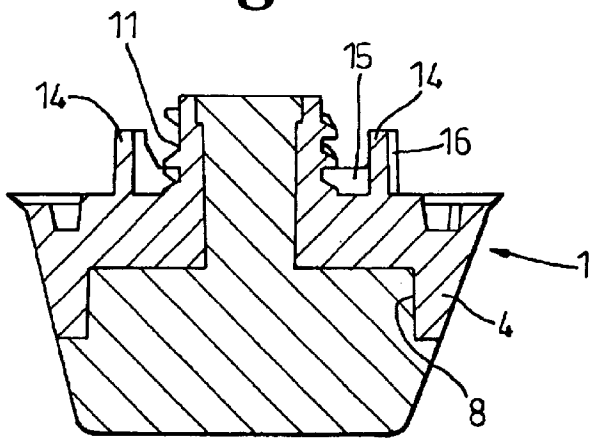

FIGS. 1 to 4 show a stud 1 suitable for use on a sports shoe such as a football boot (not shown). The stud 1 is adapted to be inserted with rotation and received in a receptacle 2, shown in FIGS. 5 and 6, which is moulded into or otherwise attached to a sole or heel of the sports shoe.

Figure 1:
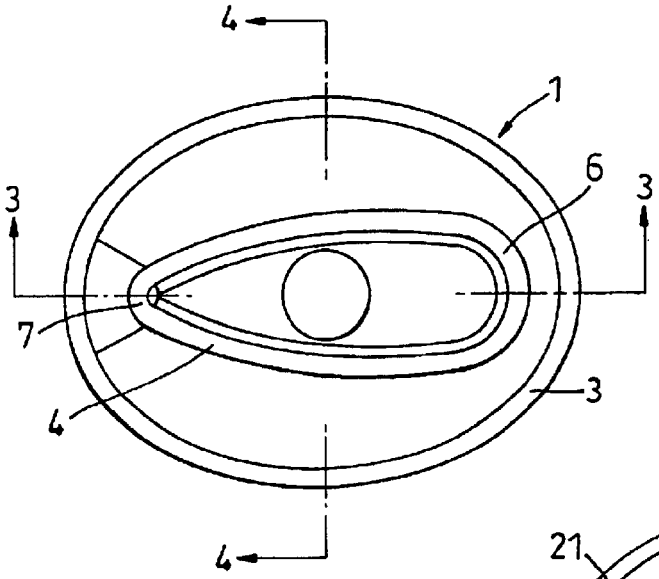
FIG. 1 is an bottom plan view of a shoe stud of the present invention.
Figure 2:
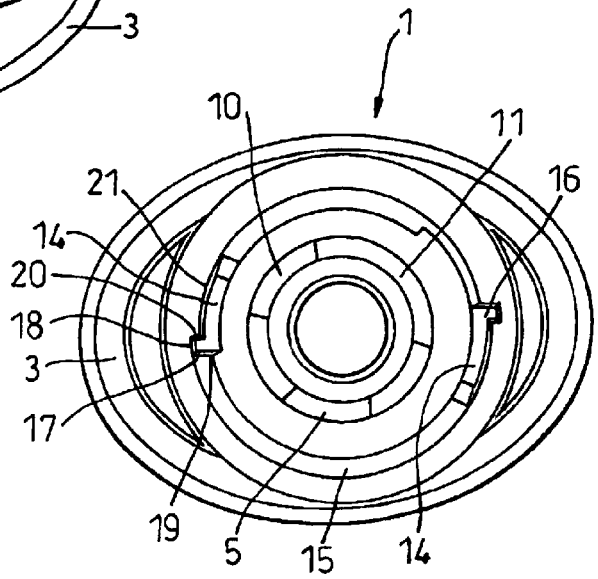
FIG. 2 is a top plan view of the stud of FIG. 1.
Figure 3:
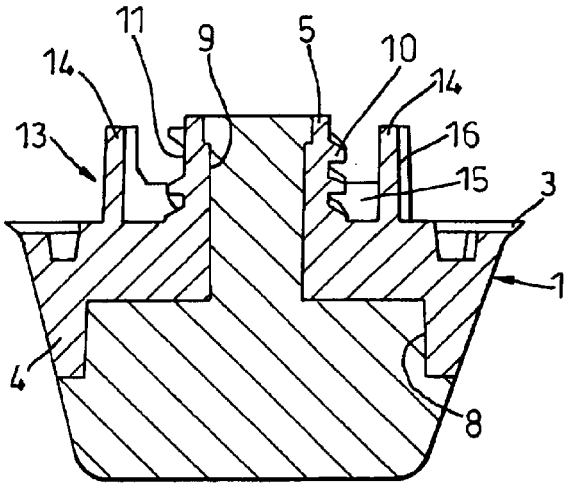
FIG. 3 is a section along the line 3—3 of FIG. 1.
Figure 4:
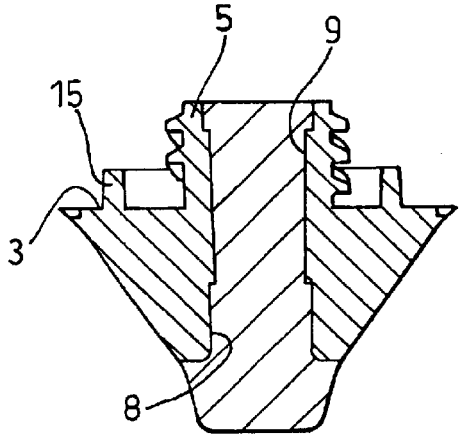
FIG. 4 is a section along the line 4—4 of FIG. 1.

The stud 1 is a unitary (i.e., one piece) melding of plastics material and has an elliptical flange 3. A ground-engaging spike or cleat 4 projects from the lower side of the flange 3, while an externally screw-threaded spigot 5 projects from the upper side. FIG. 1 shows the spike 4 to be of non-rotationally symmetrical form, being elongated along the major axis of the flange 3, rounded at one end 6, and tapering to a point at the other end 7. The spike 4 has a recess 8 at its ground-engaging end, and a plain cylindrical bore 9 extends from the recess 8 up through the spigot 5. An appropriate part is inserted in the recess 8 and bore 9 to complete the stud 1. It will be appreciated that the spike could be of any other non-rotationally symmetrical form, such as arrow-shaped. As the spike 4 is non-rotationally symmetrical, it requires to be oriented in use relative to the shoe sole. Orientation of the stud 1 in the receptacle is the first stage of this.

The external screw thread on the spigot 5 is a six-start thread, with a relatively steep helix angle, so that the stud 1 can be inserted in the receptacle 2 by half a turn although any required portion of a turn for insertion of the stud 1 can be accommodated. In order to define the initial position of the stud 1 relative to the receptacle 2, one of the threads 10 on the spigot 5 is removed to form a helical keyway 11 for a complementary key 12 formed on the screw-thread of the receptacle 2.

Because of the relatively steep helix angle of the thread, the frictional resistance to unscrewing of the stud 1 is relatively low. The stud 1 and receptacle 2 therefore have a locking means 13, which serves to secure the stud 1 in the receptacle 2, and to define its final position relative to the receptacle 2.

The stud 1 thus has a locking formation comprising a pair of diametrically opposed projections 14. Each projection 14 comprises a part-cylindrical web extending axially from a ring 15 which itself projects axially from the flange 3, radially spaced from the spigot 5. Each projection 14 has a radially-outwardly extending locking projection 16 as an axially extending rib provided on the leading end (in the screwing-up direction) of the web. A leading side face 17 of the rib is rounded off to give a smooth convex corner profile joining a flat outer face 18 of the rib and a flat leading end face 19 of the web. A trailing side face 20 of the rib is flat and generally square with the outer face 18 and with a cylindrical outer surface of the web where it joins it. The trailing end of the web is angled, so that the circumferential dimension of the lower end of the web where it joins the ring 15 is greater than the circumferential dimension at its upper end. The ring 15 is of stepped diameter, to provide two semi-circles of slightly different diameter, with one projection 14 projecting from each semi-circle such that the radial spacing of the two projections 14 from the spigot 5 is slightly different and their axial height is less than the axial height of the spigot 5. The axial height of the ring 15 is about half that of the spigot 5.

The receptacle 2 (see FIGS. 5 and 6) is also a unitary moulding of plastics material. It has a circular top plate 30 with a central boss 31 depending from it. An annular anchoring flange 32 is formed by a portion 33 of the plate 30 projecting radially outwards beyond the boss 31. The portion 33 has four arcuate holes 34 which assist in anchoring the flange 32 in the shoe sole or heel.

The boss 31 comprises a stout inner cylindrical wall 35 and a relatively thin and slightly flexible outer wall 36. The inner wall 35 forms an internally screw-threaded socket 37, adapted to receive the spigot 5. The socket 37 also has a six-start thread, with the key 12 formed by bridging between two adjacent threads (i.e. filling in between the crests of two adjacent threads, to be complementary to the keyway 11 formed on the stud 1 by removing a thread between two adjacent roots).

The radially outer surface 38 of the wall 35 and the radially inner surface 39 of the outer wall 36 are of stepped diameter, so that two part-annular spaces 40, 41 of different diameters are defined between them. The diameters of the spaces 40, 41 correspond to the diameters of the projections 14, so that each projection 14 can be received only in one annular space 40 or 41. The spaces 40, 41 are separated by a pair of diametrically opposed axial stops 42, which form part of the locking means.

The locking means on the receptacle is provided as two locking formations on the outer wall 36, formed on the inner surface 39 of that wall to face radially inwards. Each formation has a recess 44 bordered on one circumferential side by a lead-in ramp 45, and on the other side by the stop 42. The ramps 45 extend at most round an eighth of the circumference of the wall 36, and have an axial height of about one-third of the axial height of the walls 35, 36. This ensures that the locking means operates right at the end of the insertion of the spigot 5 into the socket 37.

In use the receptacle 2 is incorporated in the sole or heel of a sports shoe. Normally the receptacle 2 is moulded into the shoe sole or heel. Because the stud 1 needs to be specifically-oriented, the receptacle 2 must also be oriented precisely in the shoe sole or heel. The stepped outer wall 36 may be used to orient the receptacle 2 in a mould, or other orienting features (not shown) may be provided on the receptacle 2.

The stud 1 is installed by the insertion of the spigot 5 into the socket 37, with the projections 14 being received in the annular spaces 40, 41 at the same time. Because of the key 12 and keyway 11 there is only one position in which the threads on the spigot 5 and socket 37 can start to engage. Rotation of the stud 1 causes the spigot 5 to be drawn into the socket 37, and the projections 14 into the annular spaces 40, 41. The shape of the threads is such that full insertion of the stud 1 takes only half a turn. For the last quarter of the insertion movement of the locking projections 16 engage with the lead-in ramps 45, and then snap into the recesses 44 between the ramps 45 and the stops 42. Further rotation is therefore prevented by the engagement of the projections 16 with the stops 42. The outer wall 36 deforms resiliently as the projections 16 ride over the ramps 45, but returns to its original shape when the projections reach the recesses 44. As the projections 16 snap into the recesses 44 they make a click, which can be felt and/or heard, and signal that the insertion of the stud 1 is complete.

The initial position of the stud 1 relative to the receptacle 2 is determined by the key 12 and keyway 11, and to a lesser extent by the projections 14. The final position is determined by the locking means, thus ensuring that in the final position the stud 1 is precisely oriented relative to the receptacle 2.

FIGS. 7 to 10 show a modified stud 1 and receptacle 2, and corresponding reference numerals have been applied to corresponding parts. The main difference with the embodiment of FIGS. 7 to 10 is that the projections 14 on the stud 1 are on the same diameter, thus simplifying the construction. The projections 14 are of the same shape as in the first embodiment, with similar locking projections 16.

The receptacle 2 is modified to suit the stud 1. In the receptacle 2 the radially outer surface 38 of the wall 35 and the radially inner surface 39 of the outer wall 36 are each now of a constant diameter, so that the part-annular spaces 50 are the same, being defined between the stops 42. It will also be noted that the anchoring flange 32 is oval rather than circular, with the holes 34 being modified.

Otherwise, the construction and operation of the embodiment of FIGS. 7 to 10 is the same as that of FIGS. 1 to 6.

In a modification of either embodiment (not shown) the helical key 12 may be provided on the stud 1, and the keyway 11 on the receptacle 2.

In another modification (not shown) it would be possible to provide more than two locking formations for added security, as long as they only come into engagement at the end of insertion of the stud 1.

Figure 11:
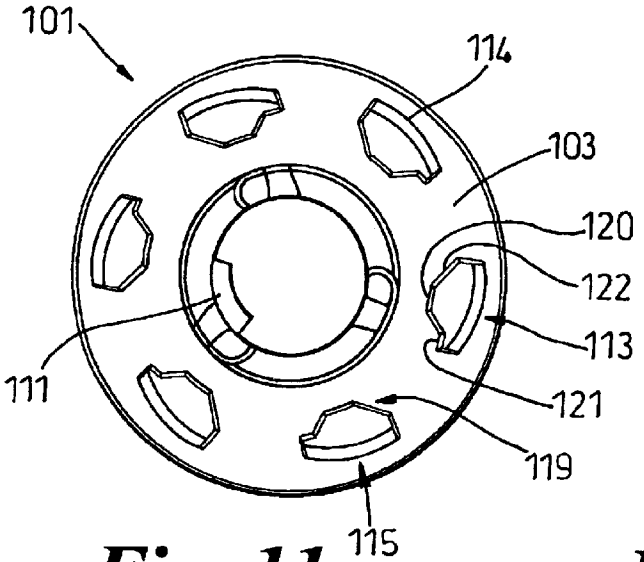
FIGS. 11 and 12 are similar to FIGS. 7 and 8, but show a different type of stud.
Figure 12:
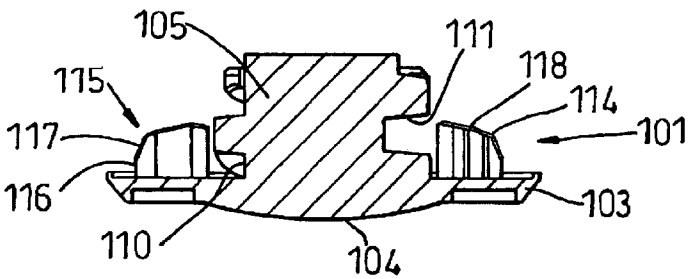

FIGS. 11 to 14 show another embodiment of the invention, where the stud 101 of FIGS. 11 and 12 is suitable for use on a golf shoe (not shown). The stud 101 is adapted to be inserted with rotation and received in a receptacle 102, shown in FIGS. 13 and 14, which is moulded into or otherwise attached to a sole or heel of the golf shoe.

The stud 101 is a unitary moulding of plastics material, with a circular flange 103. The lower side of the flange 103 is provided with a ground-engaging formation 104.

As shown, the formation 104 is part-spherical, but it may have any conventional form, such as one or more ground-engaging spikes (not shown). The formation 104 may be rotationally symmetrical or non-rotationally symmetrical, and so means are provided for orienting it relative to the receptacle.

An externally-threaded spigot 105 projects from the upper side of the flange 103. The external screw thread on the spigot 105 is a three-start thread, with a relatively steep helix angle, so that the stud 101 can be inserted in the receptacle 102 in half a turn. In this embodiment, in order to define the initial position of the stud 101 relative to the receptacle 102, one of the thread grooves 111 on the spigot 105 is deeper in the radial direction than the other two 110, to form a keyway for a complementary key 112 on the screw-thread of the receptacle 102.

As in the previous embodiments, because of the relatively steep helix angle of the thread, the frictional resistance to unscrewing of the stud 101 is relatively low. The stud 101 and receptacle 102 therefore have a locking means 113, which secures the stud in the receptacle, and defines its final position relative to the receptacle. The locking means 113 is substantially different from that of FIGS. 1 to 10, as for golf shoe studs the securing of the stud 101 in the receptacle 102 is not so critical as for football studs because the forces applied to the stud in use are in general smaller. The locking means 113 therefore comprises a ring of resilient posts 114 on the stud 101, co-operating with a ring of teeth on the receptacle 102.

The resilient posts 114 extend axially from the upper side of the flange 103. The posts 114 surround the spigot 105, and form a ring concentric with the spigot 105. There are six posts 114, distributed uniformly about the axis of the stud 101. The axial extent of each post 114 is about half the axial height of the spigot 105, and each post 114 is radially resilient. The radially outer surface 115 of each post 114 has a lower part-cylindrical portion 116, and an upper part-conical portion 117. The top surface 118 of each post is also angled up towards the spigot 105, so that the radially inner surface 119 of each post 114 has the greatest axial height. The radially inner surface 119 of each post 114 is generally convex towards the spigot 105, with a central convex region 120, a first circumferential end 121 having a concave profile towards the spigot 105, and a second circumferential end 122 having a convex profile towards the spigot 105. The first end 121 is the leading end and the second end 122 the trailing end on insertion of the stud 101, and vice versa when it is removed. The concave profile of the first end 121 presents less resistance on insertion of the stud 101, while the convex profile of the second end 122 presents greater resistance on removal.

Figure 13:
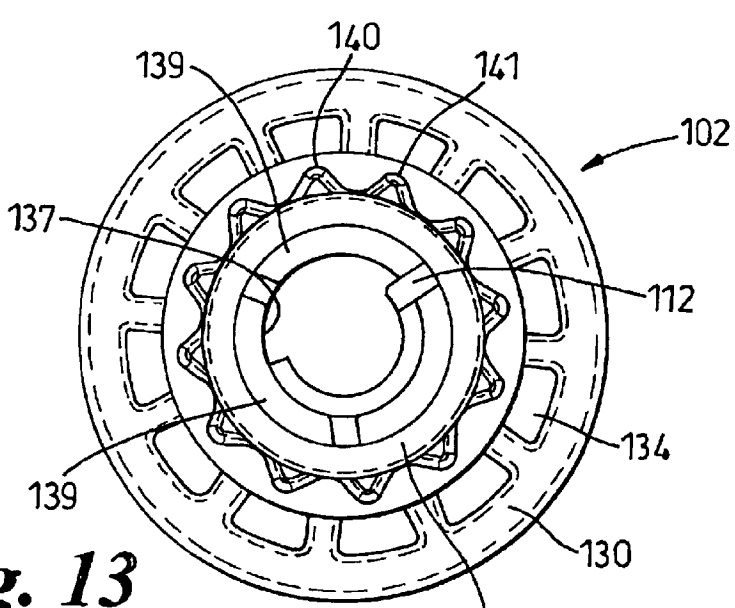
FIGS. 13 and 14 are similar to FIGS. 9 and 10, and show a modified receptacle for the stud of FIGS. 11 and 12.
Figure 14:
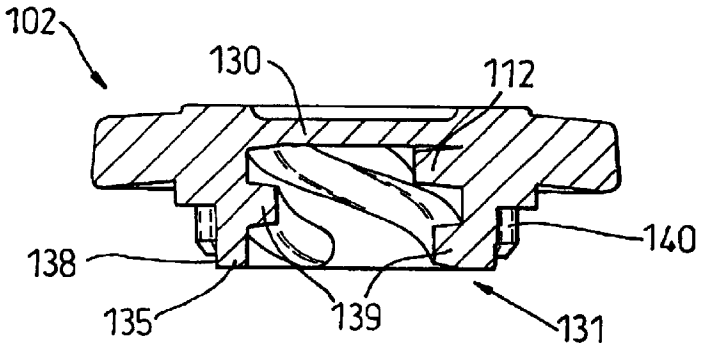

The receptacle 102 of FIGS. 13 and 14 is also a unitary moulding of plastics material. It has a circular top plate 130 with a central boss 131 depending from it. The receptacle 102 is anchored in the shoe sole or heel by the top plate 130, which includes perforations 134 to assist in this.

The boss 131 has a stout cylindrical wall 135, whose inside forms an internally screw-threaded socket 137 adapted to receive the spigot 105. The socket 137 also has a three-start thread, with one of the threads 112 being enlarged radially in relation to the other two 139, to be the complementary keyway 112 for the enlarged groove 111 on the spigot 105. It will be seen from FIG. 14 that the axial dimension of the thread 112 is the same as that of the other two 139. The radially outer surface 138 of the wall 135 is formed with part of the locking means 113, as a ring of axially extending teeth 140, projecting radially outwards from the surface 138. The teeth 140 are in the form of short stubby ribs which extend in a direction parallel to the axis of the socket 137. In cross-section the teeth are generally triangular, but with a rounded apex 141. The teeth 140 are uniformly distributed about the socket axis, there being twelve teeth in the embodiment shown.

The distance of radial projection of the teeth 140 from the socket axis is substantially equal to that of the inner surfaces of the posts 114 at the first circumferential end 121. Thus, there is radial interference between the teeth 140 and the posts 114 which causes frictional resistance to relative rotation of the stud 101 and the receptacle 102.

In use, the receptacle 102 is incorporated in the sole or heel of a golf or other sports shoe, normally by moulding. If the stud 101 needs to be specifically-oriented, the receptacle 102 must also be oriented precisely in the shoe sole or heel. The enlarged thread 112 may be used as an orienting feature, or other features (not shown) may be provided.

The stud 101 is installed by the insertion of the spigot 105 into the socket 137. Because of the enlarged thread 112 and enlarged groove 111 there is only one position in which the threads on the spigot 105 and socket 137 can start to engage. Rotation of the stud 101 causes the spigot 105 to be drawn into the socket 137, and as the spigot 105 is screwed in, the teeth 140 engage with the posts 114. Rotation is resisted by engagement of the teeth 140 with successive posts 114. As the teeth 140 are substantially incompressible, the posts 114 deflect radially in a resilient manner, to allow the teeth 140 to move past the posts 114. The profile of the radially inner surface of the posts 114 allows relatively easy movement of the teeth 140 past the posts 114, although as the spigot 105 goes further into the socket 137, the posts 114 are less easily deflected. Upon rotation of the spigot 105 relative to the socket 137 by 180°, a position which is defined when each tooth 140 has passed its third post 114, the stud 101 is fully inserted in the receptacle, and is secured by the inter-engagement of the teeth 140 and posts 114.

Thus, as in the previous embodiments, the initial position of the stud 101 relative to the receptacle 102 is determined by the key thread 112 and the keyway groove 111. The final position is determined by the length of the threads and the locking means 113, thus ensuring that in the final position the stud 101 is precisely oriented relative to the receptacle 102.

The locking means 113 of FIGS. 11 to 14 could be used instead of the locking means 13 of FIGS. 1 to 10, and vice versa.

In a modification of FIGS. 11 to 14 (not shown) the enlarged thread could be provided on the stud 101, and the enlarged groove on the receptacle 102.

The invention is highly advantageous in that it provides an effective and easily utilized means and method for properly positioning a specifically oriented stud or cleat on a shoe sole.

Having described preferred embodiments of new and improved studded footware and method of employing same, it is believed that other modifications, variations and changes will be suggested to those skilled in the art in view of the teachings set forth herein. It is therefore to be understood that all such variations, modifications and changes are believed to fall within the scope of the present invention as defined by the appended claims. Although specific terms are employed herein, they are used in a generic and descriptive sense only and not for purposes of limitation.

What is claimed is:

1. A combination of a shoe stud an receptacle wherein the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means for the components arranged to become inter-engaged at least when the spigot is fully inserted into the socket to resist unscrewing of the assembly, characterized in that the stud and receptacle have means for determining the initial position of the stud relative to the receptacle, and means for determining the final position of the stud relative to the receptacle.

2. The combination of claim 1, characterized in that the threaded connection is a three-start thread.

3. The combination of claim 1, characterized in that the threaded connection is a six-start thread.

4. The combination of claim 1, characterized in that the means for determining the initial position of the stud relative to the receptacle is provided by the threaded connection, with one of the threads and grooves being different from the other or others to provide a key and complementary keyway.

5. The combination of claim 4, characterized in that the key comprises an enlarged thread on one of the components and a correspondingly enlarged groove on the other component.

6. The combination of claim 5, characterized in that the thread and groove are enlarged radially.

7. The combination of claim 4, characterized in that the key comprises a bridged thread on one of the components and removed thread on the other component.

8. The combination of claim 4, characterized in that the key is provided on the receptacle and the keyway on the stud.

9. The combination of claim 4, characterized in that the key is provided on the stud and the keyway on the receptacle.

10. The combination of claim 4, characterized in that the locking means comprises radially-facing locking formations on the stud and receptacle operative to come into mutual engagement when the spigot has been screwed into the socket to a predetermined axial position.

11. The combination of claim 10, characterized in that one of the locking formations comprises at least one radial projection while the other comprises at least a radially-facing lead-in ramp, recess and stop means.

12. The combination of claim 10, characterized in that two locking formations are provided.

13. The combination of claim 12, characterized in that the locking formations are on different diameters.

14. The combination of claim 4, characterized in that the locking means comprises locking formations as a ring of posts extending axially from one of the components and a ring of radially projecting teeth on the other component, arranged such that when the spigot has been screwed into the socket to a predetermined axial position, engagement of the teeth with the posts causes resilient deflection of the posts, and engagement of the teeth between the posts causes inter-engagement of the locking means.

15. The combination of claim 4, characterized in that the stud is a specifically-oriented stud.

16. A combination of a shoe stud component and receptacle component having a specific orientation when secured together, wherein the shoe stud includes a ground-engaging part and the two components are adapted to be secured together by a multi-start threaded connection comprising a screw-threaded spigot on one of the two components adapted to be inserted with rotation into a screw-threaded socket on the other component, and a locking means for the components arranged to become inter-engaged at least when the spigot is fully inserted into the socket to resist unscrewing of the assembly, said combination comprising:

means for determining an initial position of the stud relative to the receptacle, wherein said initial position is the only position in which the screw-threaded spigot and the screw threaded socket can start to engage; and means for determining a final position of the stud relative to the receptacle, wherein said final position corresponds to said specific orientation of said stud component and receptacle component.

17. The combination of claim 16, characterized in that the means for determining the initial position of the stud relative to the receptacle is provided by the threaded connection, with one of the threads and grooves being different from the other or others to provide a key and complementary keyway.

18. A stud for insertion into a multi-start screw-threaded socket in an article of studded footwear from only one rotational position relative to the socket, said stud having a spigot with a multi-start screw thread complementary to the screw thread of the socket, such that rotary insertion of the spigot into the socket securely engages the stud in the receptacle, said stud characterized in that the spigot has one component of a helical key and complementary keyway of which the other component is provided on the receptacle, the helical key and keyway defining the only one rotational position of the stud relative to the socket at the start of the insertion of the spigot into the socket.

* * * * *